US009414671B1

(12) United States Patent
Smith

(10) Patent No.: US 9,414,671 B1
(45) Date of Patent: Aug. 16, 2016

(54) BOTTLE RACK ASSEMBLY

(71) Applicant: Bonnie Krensavage Smith, Presto, PA (US)

(72) Inventor: Bonnie Krensavage Smith, Presto, PA (US)

(73) Assignee: Bonnie Krensavage Smith, Presto, PA (US)

( * ) Notice: Subject to any disclaimer, the term of this patent is extended or adjusted under 35 U.S.C. 154(b) by 0 days.

(21) Appl. No.: 14/863,738

(22) Filed: Sep. 24, 2015

(51) Int. Cl.
*A47B 73/00* (2006.01)
*A47B 96/02* (2006.01)

(52) U.S. Cl.
CPC ..... *A47B 73/00* (2013.01); *A47B 96/021* (2013.01)

(58) Field of Classification Search
CPC ..... A47B 73/00; A47F 7/28
See application file for complete search history.

(56) References Cited

U.S. PATENT DOCUMENTS 242,607 A * 8/1881 Cutter ..... B65D 85/672
3,351,210 A * 11/1967 Murcott ..... A61J 7/0069 206/364
4,567,989 A * 2/1986 Hurst, Jr. ..... A47B 73/006 211/194
5,027,959 A * 7/1991 Luukkonen ..... A47B 57/36 211/181.1
D374,594 S * 10/1996 Munoz ..... D7/708
6,422,406 B1 * 7/2002 Kessel ..... A47B 47/03 211/181.1
6,619,489 B2 * 9/2003 Kessel ..... A47B 47/03 211/181.1
7,300,121 B2 * 11/2007 Diebold ..... A47B 73/00 312/408
D566,490 S * 4/2008 Frentzel ..... D7/701
D603,228 S * 11/2009 Frentzel ..... D3/311
8,231,015 B2 7/2012 McCain
8,720,704 B2 5/2014 Gupta
9,211,009 B2 * 12/2015 Greenwood ..... A47B 73/00
2002/0134744 A1 * 9/2002 Kessell ..... A47B 47/03 211/187
2004/0135481 A1 * 7/2004 Diebold ..... A47B 73/00 312/408
2004/0174108 A1 * 9/2004 Benitsch ..... F25D 25/024 312/408
2007/0080124 A1 * 4/2007 Frentzel ..... A47B 45/00 211/74
2013/0233818 A1 * 9/2013 Gupta ..... A47B 73/00 211/134
2014/0284289 A1 * 9/2014 Perez ..... A47B 73/00 211/49.1

FOREIGN PATENT DOCUMENTS

FR 576705 A * 8/1924 ..... A47B 73/00
FR 763703 A * 5/1934 ..... A47B 73/00

* cited by examiner

*Primary Examiner* — Joshua Rodden
*Assistant Examiner* — Kimberley S Wright
(74) *Attorney, Agent, or Firm* — Cooper Legal Group LLC

(57) ABSTRACT

A bottle rack assembly selectively supports one or more bottles. The bottle rack assembly includes a first support structure defining a first opening and a second support structure defining a second opening. The bottle rack assembly includes a support shelf that is received within the first opening of the first support structure and within the second opening of the second support structure such that the support shelf is supported between the first support structure and the second support structure. The support shelf includes a first support platform extending along a first support direction that is substantially perpendicular to a first direction and a second direction along which the first support structure and the second support structure extend. The first support platform defines a first support channel defined within a first upper surface of the first support platform.

20 Claims, 8 Drawing Sheets

BOTTLE RACK ASSEMBLY

TECHNICAL FIELD

The instant application is generally directed towards a bottle rack assembly. For example, the instant application is directed towards a bottle rack assembly for supporting one or more bottles, such as wine bottles, containers, cylinders, etc.

BACKGROUND

Bottle rack assemblies have traditionally been used to support one or more bottles, cylinders, containers, etc. with a number of limitations. Examples of limitations normally encountered with existing bottle rack assemblies included that assemblies supported single or multiple bottles in only one direction (e.g., side-to-side/lateral or front-to-back/orthogonally). Assemblies were also generally limited to supporting a single size bottle, as such, a variety of differently sized bottles typically could not be stored by a single bottle rack assembly efficiently. Assemblies were semi-permanent or permanent configurations thus committing a user to a specific arrangement of the bottles absent a full redesign and reinstall.

In past examples, bottle rack assemblies were limited to storing bottles (e.g., wine bottles) in a static configuration. For example, bottle sizes of 375 milliliters, 750 milliliters, 1.5 liters, etc. were limited to being stored: (1) as single bottles orthogonally (e.g., with a base in first and with a mouth and cork of the bottle visible from an outside, perpendicular to the wall, with the bottle label hidden); (2) in a bulk storage unit having a rectangular or diamond shape for holding case or near-case quantities of the bottles orthogonally; or (3) in a metal wiring display suited for displaying single layers of wine laterally (e.g., parallel to the wall with the label exposed).

One problem with these past configurations is that a square, single-bottle racking design for 375 mL, 750 mL, and 1.5 L do not allow for interchangeability of bottles (e.g., the 375 mL bottle would fall through a space designed for a 1.5 L bottle and/or 1.5 L bottles would not be adequately supported in a space designed for a 375 mL bottle). Additionally, a round single bottle racking system is generally downward compatible by one size only (e.g., 375 mL can bit in a 750 mL size, 750 mL can fit in the 1.5 L size). In addition to being unattractive and disorderly in appearance, it is also a very inefficient use of space.

Another problem with past configurations is that square and round bottle storage can disfigure the valued label based on a relatively tight fit (e.g., square space with protruding supports) or due to harsh materials (e.g., concrete rounds). Square bulk racking increases the risk of bottles rolling around, as stacking is not supported so that layered bottles may often appear disorderly. Diamond bulk racking secures the bottles in a stacking configuration, but the structural designs have partial diamond shapes, which are relatively inefficient and may damage the label. Square and diamond bulk are both space inefficient for partially filled configurations.

In addition, due to the weight and risk of breakage, past racks are relatively permanently affixed with pre-determined and permanent designs that may not be able to be modified. This permits limited to no flexibility in the absence of a full re-installation.

Accordingly, at least for these reasons, it would be beneficial to provide a bottle rack assembly that provides for improved flexibility in supporting bottles.

SUMMARY

This summary is provided to introduce a selection of concepts in a simplified form that are further described below in the detailed description. This summary is not intended to identify key factors or essential features of the claimed subject matter, nor is it intended to be used to limit the scope of the claimed subject matter.

As an example, a bottle rack assembly for selectively supporting one or more bottles in single layer or in bulk with multiple layers is provided and described in 3 parts: vertical structure component to house the shelves, the ubiquitous support shelf, and the multitude of bottle configurations possible using the flexible vertical supports and ubiquitous shelving.

The vertical structure is comprised of an odd quantity of vertical support structures which are stabilized on the top and bottom to create vertical columns to accept the support shelving and affixed to the wall for stability The quantity of vertical structures can comprise two vertical structures to create one shelving column, but appending subsequent vertical structures creates additional shelving columns. The quantity of columns is unlimited enabling total flexibility in the width of the display. The spacing between the verticals is dictated by the width of the shelf, in this case the length of a wine bottle. The vertical height is limited only by material choice. The verticals are stabilized by four removable transoms affixed across the top and bottom, front and back of the vertical components corners. Each vertical has horizontal support braces to fully support the shelves on both sides. The length of the horizontal support extends beyond the fulcrum or pivot points of the front and back shelf lateral to ensure shelf stability once bottles are placed on the shelf. The vertical distance between the horizontal shelf supports is optimized by the height of the desired bottle circumference, in this case a 375 ml, a 750 ml or a 1.5 L wine bottle. The shelf support design enables shelves to be easily re-positioned vertically shifting easily between single row and bulk storage. Once assembled to the desired width, the structure is affixed to the wall using removable anchors.

The bottle rack assembly is also comprised of multiple ubiquitous support shelves, placement and quantity of which are completely flexible. The shelf rests on the horizontal supports incorporated into the vertical structure. The shelves can be easily re-positioned by sliding the shelf out and placing it onto another pair of horizontal supports within a vertical column. The support shelf may comprise three lateral supports that are integrated into two end supports that rest on the vertical's shelf supports such that the fulcrum points of the front and back lateral are within the lateral support. The front lateral support is channeled to hold a bottle laterally. The middle and back lateral supports are channeled in two directions: a) lateral channel similar to the front lateral, which enables lateral placement of bottles, and b) perpendicular channels to space bottle orthogonally. The width and depth of the channels are optimized for bottle stability based on the desired bottle sizes to be stored, in this case, 375 ml, 750 ml and 1.5 L wine bottles. The width and depth are sufficient to hold the bottles in position for display purposes as well anchor a bottom with enough stability to enable stacking of bottles without movement, e.g., in a pyramid. Lastly, the lateral space between the 3 lateral supports holds regular and/or oversized bottles laterally. The shelf (as illustrated herein), without any alteration or movement, can hold in single layers one to three bottles laterally, one to four bottles orthogonally, and can accommodate all three of the sample sizes of 375 ml, 750 ml and 1.5 L. The shelf, without any alteration or movement, can also hold more than a case of wine orthogonally in a nested configuration or in a pyramid that holds its position and shape with a reduced risk of damaging the bottles. More than 35 configurations of the example bottles were tested and are secure. The shelf is of an open design thus eliminating any risk to the labeling on the bottles, in this case the valued wine label.

When the vertical structure and shelves are combined, the combination of bottle storage has an improved flexibility. The height is unlimited and can be optimized based on the most typical bottle size, in this example a 375 ml, a 750 ml or a 1.5 L wine bottle. The quantity of vertical columns is unlimited. The vertical column and shelf widths are dictated by the maximum preferred bottle length, in this example wine bottles. The quantity of shelves utilized and the spacing are flexible and swiftly altered. In this example of optimization around 375 ml, 750 ml and 1.5 L wine bottles, the configurations possible are illustrated as at least 70 configurations using the three common wine bottle sizes. This flexibility permits any of the 70 permutations to be implemented side-by-side with, at most, the simple repositioning of the shelf. The material shown is wood, but it can be constructed of any material capable of holding the requisite weight and receiving the required channels.

The following description and annexed drawings set forth certain illustrative aspects and implementations. These are indicative of but a few of the various ways in which one or more aspects can be employed. Other aspects, advantages, and/or novel features of the disclosure will become apparent from the following detailed description when considered in conjunction with the annexed drawings.

In an example, a bottle rack assembly for selectively supporting one or more bottles comprises a support shelf extending between a first end and a second end. The first end of the support shelf is configured to be supported by a first support structure. The second end of the support shelf is configured to be supported by a second support structure. The support shelf comprises a first support platform extending between the first end and the second end. The first support platform defines a first support channel configured to receive one or more of the bottles in a first position. The first support platform defines at least one transverse support channel. The transverse support channel extends in a direction that is substantially perpendicular to the first support channel. The transverse support channel is configured to receive one or more of the bottles in a second position that is different than the first position. The first support platform comprises a second support platform extending between the first end and the second end. The second support platform defines a second support channel.

In another example, a bottle rack assembly for selectively supporting one or more bottles is provided. The bottle rack assembly comprises a first support structure extending substantially vertically along a first direction. The first support structure defines a first opening. The bottle rack assembly comprises a second support structure extending substantially vertically along a second direction that is substantially parallel to the first direction. The second support structure defines a second opening. The second opening is spaced apart and faces the first opening of the first support structure. The bottle rack assembly comprises a support shelf extending between a first end and a second end. The first end of the support shelf is configured to be received within the first opening. The second end of the support shelf is configured to be received within the second opening such that the support shelf is supported between the first support structure and the second support structure. The support shelf comprises a first support platform extending between the first end and the second end. The first support platform extends along a first support direction that is substantially perpendicular to the first direction and the second direction. The first support platform defines a first transverse support channel defined within a first upper surface of the first support platform. The first transverse support channel extends along a second support direction that is substantially perpendicular to the first support direction.

In another example, a bottle rack assembly for selectively supporting one or more bottles, cylinders, or containers is provided. The bottle rack assembly comprises a support shelf extending between a first end and a second end. The support shelf comprises a set of support platforms extending between the first end and the second end and are parallel to each other with spaces in between and perpendicular to the first end and the second end. In this example, there are three supports, it could have just as easily had fewer or greater quantities. Each support shelf can have a dual channel structure: one channel to support bottles or cylinders laterally and transverse channels optimized based on bottle sizes that support bottles or cylinders orthogonally. The placement of the channel combinations is optimized based on the bottle or cylinder sizes. In this example, all three shelf supports have full-length lateral channels but only the center and back support have transverse channels as this was optimized for wine bottles where the front shelf needed no transverse channels.

The first support platform extends along a first support direction. The first support platform defines a first support channel defined within a first upper surface of the first support platform. The first support channel extends along the first support direction between the first end and the second end of the support shelf. The first support platform defines a first transverse support channel defined within the first upper surface of the first support platform. The third transverse support channel extends along a second support direction that is substantially perpendicular to the first support direction such that the first transverse support channel intersects the first support channel. The first transverse support channel is located a first distance from the first end of the support shelf. The support shelf comprises a second support platform extending between the first end and the second end. The second support platform extends along the first support direction. The second support platform is spaced a first support distance apart from the first support platform to define a first support opening between the first support platform and the second support platform. The second support platform defines a second support channel defined within a second upper surface of the second support platform. The second support channel extends along the first support direction between the first end and the second end of the support shelf. A first crossing support channel is defined within the second upper surface of the second support platform. The first crossing support channel extends along the second support direction that is substantially perpendicular to the first support direction such that the first crossing support channel intersects the second support channel. The first crossing support channel is located the first distance from the first end of the support shelf. The support shelf comprises a third support platform extending between the first end and the second end. The third support platform extends along the first support direction. The third support platform is spaced a second support distance apart from the second support platform to define a second support opening between the second support platform and the third support platform. The third support platform defines a third support channel defined within a third upper surface of the third support platform. The third support channel extends along the first support direction between the first end and the second end of the support shelf.

DETAILED DESCRIPTION

Figure 1:
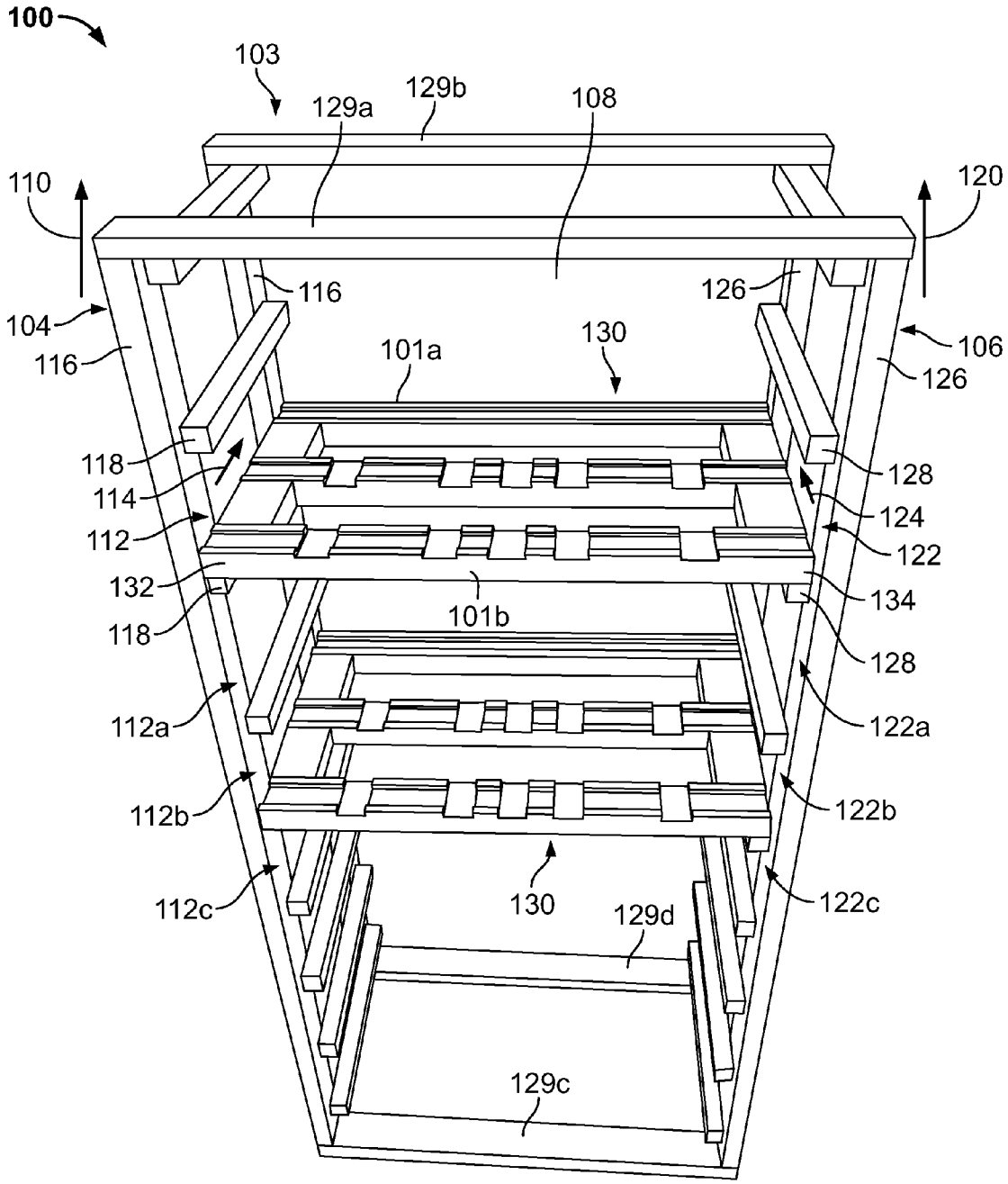
FIG. 1 is an illustration of an example bottle rack assembly, such as, for example, a single-column bottle rack assembly.

The claimed subject matter is now described with reference to the drawings, wherein like reference numerals are generally used to refer to like elements throughout. In the following description, for purposes of explanation, numerous specific details are set forth in order to provide an understanding of the claimed subject matter. It is evident, however, that the claimed subject matter can be practiced without these specific details. In other instances, structures and devices are illustrated in block diagram form in order to facilitate describing the claimed subject matter.

It is to be appreciated that the following description and illustrations are merely intended to convey one or more possible examples of the bottle rack assembly. That is, the illustrations of the bottle rack assembly, and portions thereof, in FIGS. 1 to 7 are but one example of a number of different permutations and variations of the bottle rack assembly. For example, in other possible examples, the bottle rack assembly may have dimensions (e.g., lengths, widths, etc.) that vary from the stated dimensions herein. In another example, the quantity of the structures and/or portions of the bottle rack assembly are not intended to be limiting. That is, in some examples, the bottle rack may have more channels than as illustrated of fewer channels than as illustrated. Likewise, orientations of portions of the bottle rack assembly are not intended to be limiting, as variations due to manufacturing, effectiveness, or the like are envisioned. That is, in some examples, the channels may not be perfectly parallel to each other, perpendicular to each other, etc. Accordingly, the bottle rack assembly illustrated herein comprises merely one of a number of different examples, embodiments, constructions, etc.

A bottle rack assembly can be provided for supporting one or more bottles. In an example, the bottle rack assembly can removably receive one or more support shelves. The support shelves can be vertically arranged and spaced apart. In the illustrated examples, the support shelves comprise one or more channels, indentations, grooves, openings, or the like. These channels, indentations, grooves, openings, etc. can support one or more of the bottles. When the bottles are supported by the support shelf, the bottles are restricted and/or limited from inadvertently moving, rolling, and/or otherwise becoming dislodged/separated from the support shelf. As will be described herein, the support shelf can support the bottles in a plurality of orientations, such as by extending side to side along a first direction, front to back along a second direction, etc. Additionally, the support shelf can support a variety of different sized bottles.

Turning to FIG. 1, a bottle rack assembly 100 is illustrated. The bottle rack assembly 100 can extend between a front side (e.g., in proximity to a front side 101*a* of a shelf) and a rear side (e.g., in proximity to a rear side 101*b* of the shelf). For the purposes of illustration and to more clearly illustrate portions of the bottle rack assembly 100, a view looking in towards the rear side is illustrated in FIG. 1. That is, the rear side is closer in perspective while the front side is farther in perspective. In operation, however, the rear side may abut against, be in contact with, attached to, etc. a wall, a surface, or the like. The front side can be open and exposed to a user such that the user can access the bottle rack assembly 100 from the front side.

The bottle rack assembly 100 can be used for selectively supporting one or more bottles 102 (e.g., bottles 102 are illustrated in FIGS. 6A, 6B, 6C and 7) upon a shelf 130. For the purposes of illustration and to more clearly show portions of the bottle rack assembly 100 (e.g., channels, etc.), the bottle rack assembly 100 is illustrated without the bottles 102 in FIG. 1. By selectively supporting the bottles 102, it will be appreciated that the bottles 102 can be placed upon, rest upon, be removed from, etc. the bottle rack assembly 100. As will be described herein, the bottles 102 can be supported in a plurality of different positions and/or in a plurality of different orientations, as illustrated in FIG. 8. Additionally, in an example, the bottle rack assembly 100 can support bottles 102 of varying sizes.

In an example, the bottles 102 comprise wine bottles, such that the bottle rack assembly 100 can selectively support one or more wine bottles. The bottle rack assembly 100 is not so limited, however, and in other examples, the bottle rack assembly 100 can support other types of bottles, jars, containers, cylinders, etc. For example, the bottle rack assembly 100 can support liquor bottles, beer bottles, wine bottles, non-alcohol containing bottles, jars, cans, or the like.

Referring briefly to FIG. 8, a second example bottle rack assembly 190 is illustrated. As will be described in more detail below, in this example, the second example bottle rack assembly 190 can comprise a plurality of bottle rack assemblies 100. That is, the bottle rack assemblies 100 (e.g., as illustrated in FIG. 1), can be attached to each other and/or positioned side by side. In this example, the second example bottle rack assembly 190 comprises three bottle rack assemblies 100, though, in other examples, any number (e.g., one or more) of the bottle rack assemblies 100 can be provided as part of the bottle rack assembly 190. In the illustrated example, sidewalls (e.g., 116, 126) can be shared by adjacent bottle rack assemblies 100 (e.g., as illustrated in FIG. 8), though, in other examples, each bottle rack assembly can comprise its own sidewalls 116, 126. As illustrated, the second example bottle rack assembly 190 can support one or more of the bottles 102 in a plurality of different positions and/or in a plurality of different orientations.

In particular, the second bottle rack assembly 190 can support one or more support shelves 130 in a variety of different placements. For example, at a first location 131, the support shelf 130 can support a plurality of bottles 102 in a pyramid configuration, with the support shelf 130 spaced apart from an above support shelf 130 to allow for the pyramid configuration in which a plurality of bottles 102 are stacked vertically atop one another (e.g., comprising a plurality of rows of bottles). In another example, at a second location 133, the support shelf 130 can support a plurality of bottles 102 in a non-stacked configuration (e.g., comprising a single row of bottles).

I. Frame 103

Referring to FIG. 1, the bottle rack assembly 100 comprises a frame 103 having a first support structure 104, a second support structure 106, and a plurality of cross-braces (e.g., first cross-brace 129*a*, second cross-brace 129*b*, third cross-brace 129*c*, and fourth cross-brace 129*d*). The first support structure 104 and the second support structure 106 can be similar in structure. The first support structure 104 and the second support structure 106 can be spaced apart from each other to define a space 108 (e.g., an opening, channel, gap, etc.) therebetween.

Referring to the first support structure 104, the first support structure 104 extends along a first direction 110. In an example, the first support structure 104 extends substantially vertically along the first direction 110, such that the first direction 110 is substantially vertical (e.g., up and down). In other examples, however, the first support structure 104 is not so limited, and, instead, could extend at an angle with respect to vertical (e.g., up and down). The first support structure 104 can be supported at a bottom end on the ground, floor, surface, or the like. In some examples, the bottom end of the first support structure 104 comprises a base or other similar supporting device that can allow for the first support structure 104 to rest on the ground, floor, surface, or the like with limited likelihood of falling over, tipping over, or otherwise losing balance.

The first support structure 104 can define a first opening 112. In an example, the first opening 112 extends in an opening direction 114 that is substantially perpendicular with respect to the first direction 110. In this example, the opening direction 114 can be substantially horizontal and parallel with respect to the ground, floor, surface, etc. However, such a direction is not intended to be limiting. Rather, the opening direction 114 could be angled (e.g., non-perpendicular) with respect to the first direction 110. In an example, the opening direction 114 could be angled downwardly or upwardly and need not be substantially horizontal.

The first opening 112 can extend along a side of the space 108 defined between the first support structure 104 and the second support structure 106. In such an example, the first opening 112 can face towards the space 108, such that the first opening 112 extends along a side of the space 108. In this example, the first opening(s) 112 is defined by one or more sidewalls 116 and a first support ledge(s) 118. The sidewalls 116 can extend along the first direction 110 (e.g., substantially vertically up and down). The sidewalls 116 can be spaced apart, with the first support ledges 118 extending between the sidewalls 116 and attached to inner surfaces of the sidewalls 116. In this example, the first support ledges 118 can be attached at opposing ends of the first support ledges to the sidewalls 116. In some examples, the first support structure 104 comprises a plurality of first openings (e.g., first opening 112*a*, first opening 112*b*, first opening 112*c*, etc.) that are arranged vertically along the first support structure 104. In this example, the first openings 112 can be bounded at an upper and lower side by the first support ledges 118.

Referring now to the second support structure 106, the second support structure 106 extends along a second direction 120 that is substantially parallel to the first direction 110. In an example, the second support structure 106 extends substantially vertically along the second direction 120, such that the second direction 120 is substantially vertical (e.g., up and down). In other examples, however, the second support structure 106 is not so limited, and, instead, could extend at an angle with respect to vertical (e.g., up and down). The second support structure 106 can be supported at a bottom end on the ground, floor, surface, or the like. In some examples, the bottom end of the second support structure 106 comprises a base or other similar supporting device that can allow for the second support structure 106 to rest on the ground, floor, surface, or the like with limited likelihood of falling over, tipping over, or otherwise losing balance. In this example, the second support structure 106 can extend substantially parallel to the first support structure 104.

The second support structure 106 can define a second opening 122. In an example, the second opening 122 extends in an opening direction 124 that is substantially perpendicular with respect to the second direction 120. In this example, the opening direction 124 can be substantially horizontal and parallel with respect to the ground, floor, surface, etc. However, such a direction is not intended to be limiting. Rather, the opening direction 124 could be angled (e.g., non-perpendicular) with respect to the second direction 120. In an example, the opening direction 124 could be angled downwardly or upwardly and need not be substantially horizontal.

The second opening 122 can extend along a side of the space 108 defined between the first support structure 104 and the second support structure 106. In such an example, the second opening 122 can face towards the space 108, such that the second opening 122 extends along a side of the space 108. In this example, the second opening 122 is defined by one or more sidewalls 126 and a second support ledge 128. The sidewalls 126 can extend along the second direction 120 substantially parallel to the sidewalls 116. The sidewalls 126 can be spaced apart, with the second support ledges 128 extending between the sidewalls 126 and attached to inner surfaces of the sidewalls 126. In this example, the second support ledges 128 can be attached at opposing ends of the second support ledges 128 to the sidewalls 126. In some examples, the second support structure 106 comprises a plurality of second openings (e.g., second opening 122*a*, second opening 122*b*, second opening 122*c*, etc.) that are arranged vertically along the second support structure 106. In this example, the second openings 122 can be bounded at an upper and lower side by the second support ledges 128.

The second opening 122 can be spaced apart from and facing the first opening 112 of the first support structure 104. In an example, the second support structure 106 can be attached to the first support structure 104. For example, one or more cross-braces 129*a*-129*d* can be provided for attaching the sidewalls 116 of the first support structure 104 to the sidewalls 126 of the second support structure 106. In this example, a first cross-brace 129*a* can be attached at an upper end to first (e.g., front) sidewalls 116, 126. A second cross-brace 129*b* can be attached at an upper end to second (e.g., rear) sidewalls 116, 126. A third cross-brace 129*c* can be attached at a lower end to the first (e.g., front) sidewalls 116, 126. A fourth cross-brace 129*d* can be attached at a lower end to the second (e.g., rear) sidewalls 116, 126.

In an example, a support shelf 130 can be received within the first opening 112 of the first support structure 104 and the second opening 122 of the second support structure 106. In this example, a width of the support shelf 130 can be substantially equal to or less than a distance separating the sidewalls 116 from the sidewalls 126. As such, the support shelf 130 can be removably received between the sidewalls 116, 126.

Turning to the support shelf 130, the support shelf 130 extends between a first end 132 and a second end 134. The first end 132 of the support shelf 130 can be received within the first opening 112 of the first support structure 104. The second end 134 of the support shelf 130 can be received within the second opening 122 of the second support structure 106. As such, the support shelf 130 may be supported between the first support structure 104 and the second support structure 106. In some examples, the support shelf 130 can be removably supported by the first support structure 104 and the second support structure 106. For example, the support shelf 130 can be inserted into and/or removed from the space 108, such as by being inserted into and/or removed from the first opening 112 and the second opening 122. In this example, when the support shelf 130 is inserted into the first opening 112, the first end 132 of the support shelf 130 can be supported on one of the first support ledges 118. When the support shelf 130 is inserted into the second opening 122, the second end 134 of the support shelf 130 can be supported on one of the second support ledges 128.

Figure 6A:
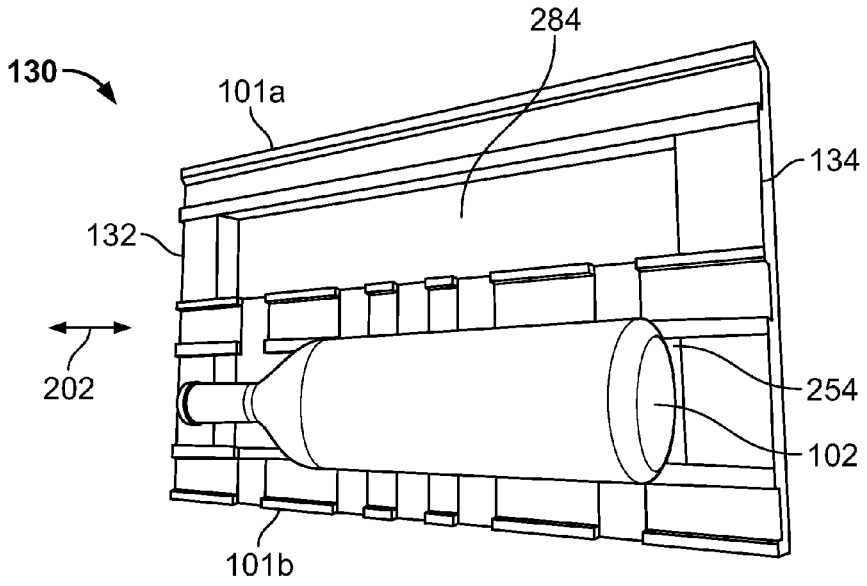
FIG. 6A is an illustration of an example support shelf supporting a bottle laterally.
Figure 6B:
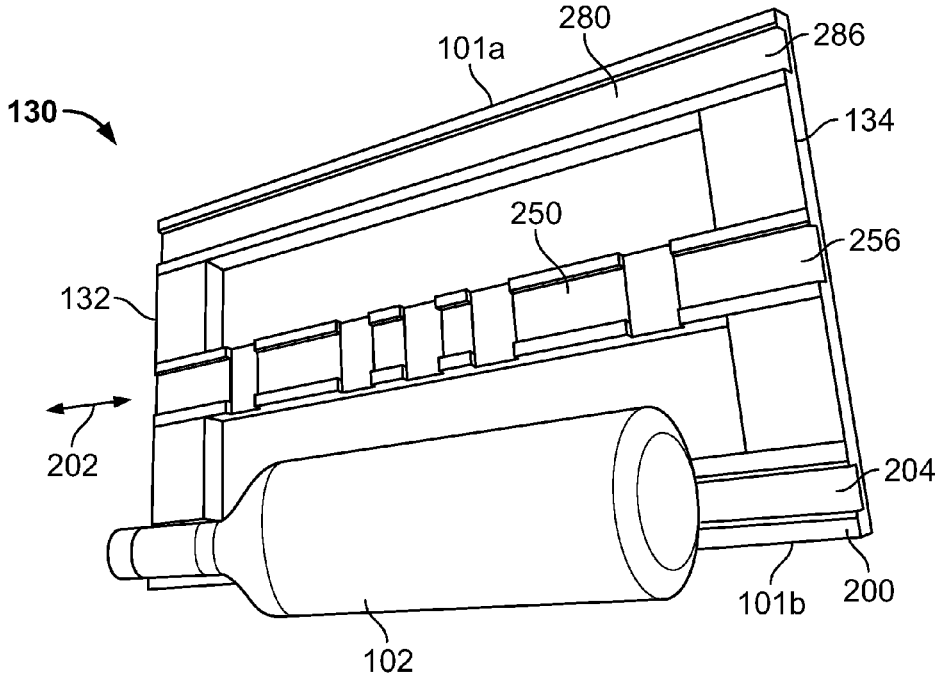
FIG. 6B is an illustration of an example support shelf supporting a bottle laterally.
Figure 6C:
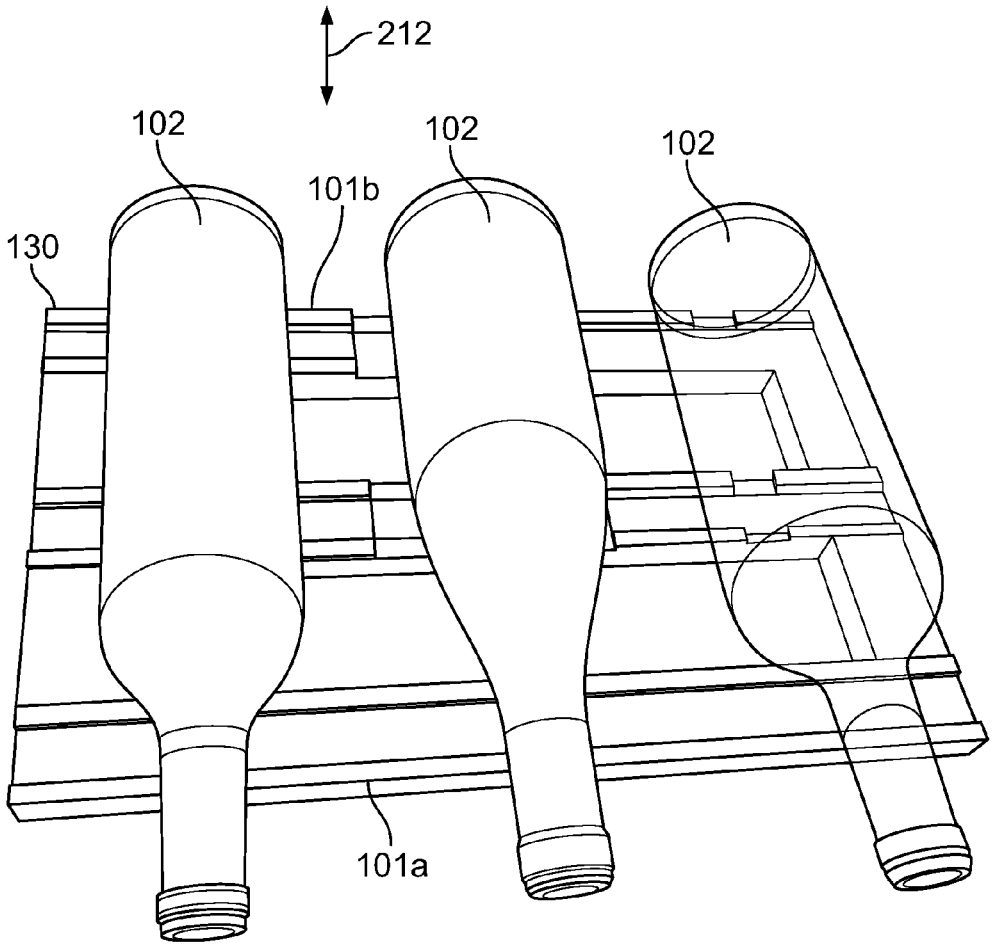
FIG. 6C is an illustration of an example support shelf supporting a bottle orthogonally.

In some examples, a depth of the support shelf 130 can be designed, optimized, etc. so as to suit a specific size of bottle 102 (e.g., as illustrated and described in FIGS. 6A, 6B, and 6C). For example, the support shelf 130 can receive and support both larger size bottles 102 and smaller size bottles 102. Along these lines, the first support ledge 118 and the second support ledge 128 can be sized, designed, optimized, etc. so as to hold the support shelf 130 and one or more bottles 102 without allowing for the support shelf 130 to tip over, become separated from the support ledges 118, 128, etc. In such an example, the first support ledge 118 and the second support ledge 128 can extend between the front side 101*a* and the rear side 101*b* a distance that substantially matches a distance of the support shelf 130 to limit inadvertent tipping and/or separation of the support shelf 130.

II. Support Shelf 130

Figure 2:
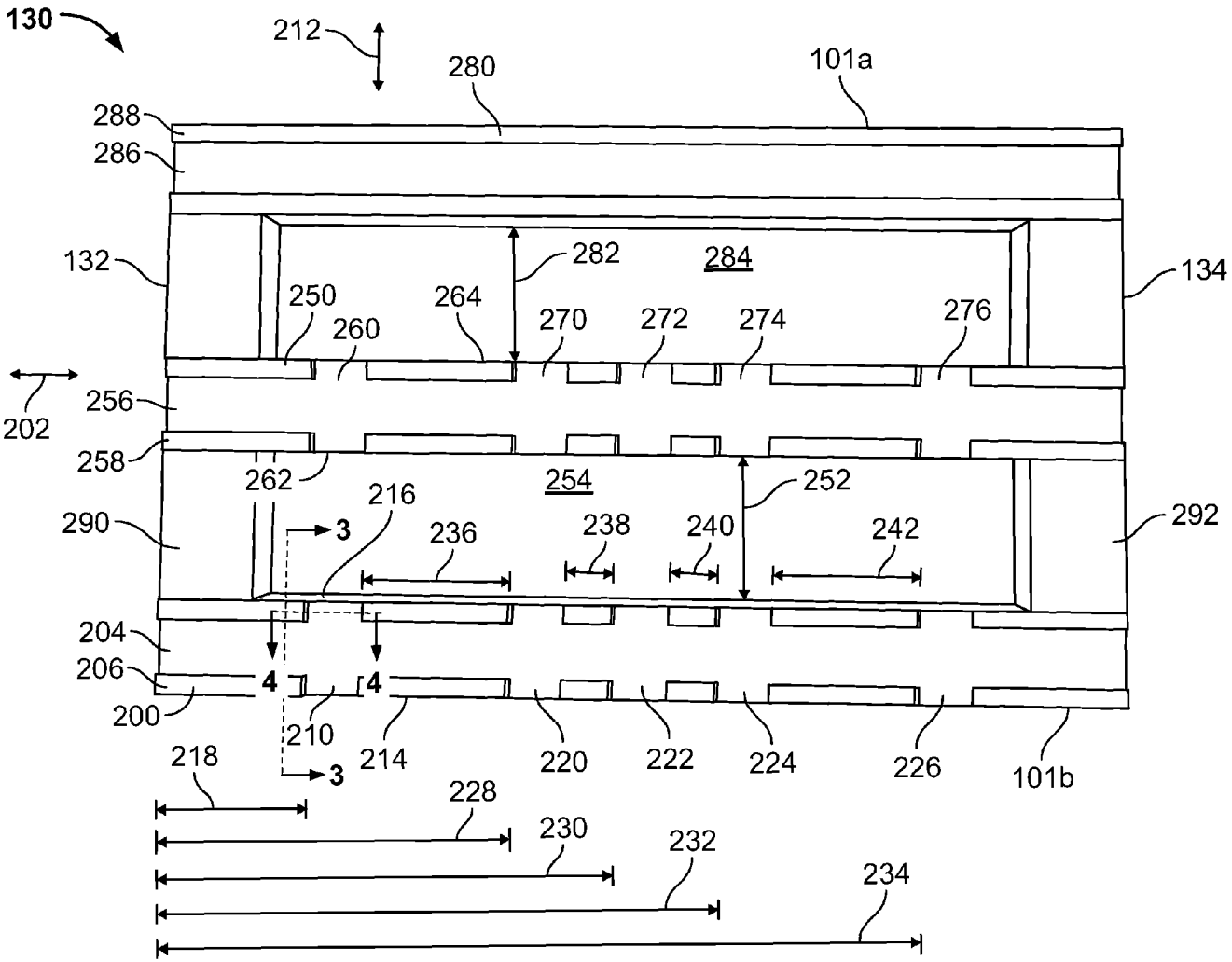
FIG. 2 is an illustration of an example support shelf for a bottle rack assembly designed for supporting a plurality of wine bottle sizes.

Turning to FIG. 2, an example of the support shelf 130 is illustrated. The support shelf 130 can be used for supporting one or more bottles 102. In an example, the support shelf comprises a first support platform 200. The first support platform 200 can extend between the first end 132 and the second end 134 of the support shelf 130. The first support platform 200 extends along a first support direction 202. In this example, the first support direction 202 is substantially perpendicular to the first direction 110 (e.g., as illustrated in FIG. 1) and the second direction 120 (e.g., as illustrated in FIG. 1).

The first support platform 200 can define a first support channel 204 that is defined within a first upper surface 206 of the first support platform 200. In an example, the first upper surface 206 is substantially planar, flat, level, etc. The first support channel 204 can define a trough, indentation, furrow, trench, or the like that projects inwardly into the first support platform 200. In this example, the first support channel 204 extends along the first support direction 202 between the first end 132 and the second end 134 of the support shelf 130. In an example, the first support channel 204 can extend along at least about one half of a length of the first support platform 200. In another example, the first support channel 204 can extend along at least about three quarters of a length of the first support platform 200. In the illustrated example, the first support channel 204 can extend along substantially an entire length of the first support platform 200.

The first support platform 200 can define one or more transverse support channels. In an example, a first transverse support channel 210 is defined within the first upper surface 206 of the first support platform 200. The first transverse support channel 210 can extend along a second support direction 212 that is substantially perpendicular to the first support direction 202. As such, the first transverse support channel 210 can intersect the first support channel 204.

The first transverse support channel 210 can define a trough, indentation, furrow, trench, or the like that projects inwardly into the first support platform 200. In this example, the first transverse support channel 210 extends along the second support direction 212 between a first side 214 (e.g., a front side) of the first support platform 200 and a second side 216 (e.g., a rear side) of the first support platform 200.

In the illustrated example, the first support platform 200 comprises five transverse support channels (e.g., 210, 220, 222, 224, 226). For example, the first support platform 200 may comprise the first transverse support channel 210, a second transverse support channel 220, a third transverse support channel 222, a fourth transverse support channel 224, and a fifth transverse support channel 226. The second transverse support channel 220, the third transverse support channel 222, the fourth transverse support channel 224, and the fifth transverse support channel 226 can be substantially similar and/or identical in size, shape, and/or orientation to the first transverse support channel 210. As such, the aforementioned description of the first transverse support channel 210 can apply to the second transverse support channel 220, the third transverse support channel 222, the fourth transverse support channel 224, and the fifth transverse support channel 226.

It will be appreciated that such a number of transverse support channels (e.g., five in this example) is not intended to be limiting. Rather, in other examples, any number (e.g., one or more) of the transverse support channels can be provided. In this example, the transverse support channels have a substantially similar and/or identical size/shape and can extend substantially parallel with respect to each other. In these examples, the transverse support channels (e.g., 210, 220, 222, 224, and 226) of the support shelf 130 can be optimized so as to support a plurality of different bottle sizes (e.g., 375 mL, 750 mL, and 1.5 L). The different sized bottles can lead to different spacing between the transverse support channels.

The first transverse support channel 210 can be located a first distance 218 from the first end 132 of the support shelf 130. The second transverse support channel 220 can be located a second distance 228 from the first end 132 of the support shelf 130. The third transverse support channel 222 can be located a third distance 230 from the first end 132 of the support shelf 130. The fourth transverse support channel 224 can be located a fourth distance 232 from the first end 132 of the support shelf 130. The fifth transverse support channel 226 can be located a fifth distance 234 from the first end 132 of the support shelf 130.

In an example, the first distance 218 may be less than the second distance 228. In an example, the second distance 228 may be less than the third distance 230. In an example, the third distance 230 may be less than the fourth distance 232. In an example, the fourth distance 232 may be less than the fifth distance 234. As such, the first transverse support channel 210 is located in closest proximity to the first end 132 while the fifth transverse support channel 226 is located in furthest proximity from the first end 132.

In some examples, a distance separating adjacent transverse support channels may vary depending on the transverse support channels (e.g., some transverse support channels are closer together than other transverse support channels). For example, a first separating distance 236 can separate the first transverse support channel 210 from the second transverse support channel 220. A second separating distance 238 can separate the second transverse support channel 220 from the third transverse support channel 222. A third separating distance 240 can separate the third transverse support channel 222 from the fourth transverse support channel 224. A fourth separating distance 242 can separate the fourth transverse support channel 224 from the fifth transverse support channel 226. In an example, the first separating distance 236, the second separating distance 238, the third separating distance 240, and the fourth separating distance 242 may or may not be equal.

In this example, the first separating distance 236 is substantially equal to the fourth separating distance 242. In this example, the second separating distance 238 is substantially equal to the third separating distance 240. As illustrated, the first separating distance 236 and the fourth separating distance 242 are greater than the second separating distance 238 and the third separating distance 240. Therefore, the second transverse support channel 220, the third transverse support channel 222, and the fourth transverse support channel 224 may be in closer proximity to each other than the first transverse support channel 210 is to the second transverse support channel 220 and/or than the fourth transverse support channel 224 is to the fifth transverse support channel 226. By having the transverse support channels separated by the illustrated separating distances, the support shelf 130 can support a number of different bottles 102 in a spaced apart configuration and/or can support bottles 120 of a variety of different sizes.

It will be appreciated that the illustrated separating distances 236, 238, 240, 242 are not intended to be limiting. Rather, in another example, the second transverse support channel 220 can be positioned in closer proximity to the first transverse support channel 210 than to the third transverse support channel 222, such that the first separating distance 236 may be less than the second separating distance 238. Likewise, in another example, the fourth transverse support channel 224 can be positioned in closer proximity to the fifth transverse support channel 226 than to the third transverse support channel 222, such that the fourth separating distance 242 may be less than the third separating distance 240.

Referring still to FIG. 2, the support shelf comprises a second support platform 250. The second support platform 250 can extend between the first end 132 and the second end 134 of the support shelf 130. The second support platform 250 extends along the first support direction 202. In this example, the second support platform 250 extends substantially parallel to the first support platform 200.

The second support platform 250 is spaced a first support distance 252 away from the first support platform 200. In this example, the second support platform 250 and the first support platform 200 define a first support opening 254 between the first support platform 200 and the second support platform 250. In an example, the first support opening 254 is large enough to support a bottle 102 (e.g., a wine bottle), while not being so large so as to allow for the bottle 102 to fall through the first support opening 254.

The second support platform 250 can define a second support channel 256 that is defined within a second upper surface 258 of the second support platform 250. In an example, the second upper surface 258 is substantially planar, flat, level, etc. In an example, the second upper surface 258 is substantially parallel to and/or coplanar with the first upper surface 206. The second support channel 256 can define a trough, indentation, furrow, trench, or the like that projects inwardly into the second support platform 250. In some examples, the second support channel 256 is substantially similar and/or identical (e.g., in size/dimensions, shape, orientation, etc.) to the first support channel 204.

The second support channel 256 extends along the first support direction 202 between the first end 132 and the second end 134 of the support shelf 130. In an example, the second support channel 256 can extend along at least about one half of a length of the second support platform 250. In another example, the second support channel 256 can extend along at least about three quarters of a length of the second support platform 250. In the illustrated example, the second support channel 256 can extend along substantially an entire length of the second support platform 250.

The second support platform 250 can define one or more crossing support channels. In an example, a first crossing support channel 260 is defined within the second upper surface 258 of the second support platform 250. The first crossing support channel 260 can extend along the second support direction 212 that is substantially perpendicular to the first support direction 202. As such, the first crossing support channel 260 can intersect the second support channel 256.

The first crossing support channel 260 can define a trough, indentation, furrow, trench, or the like that projects inwardly into the second support platform 250. In this example, the first crossing support channel 260 extends along the second support direction 212 between a first side 262 (e.g., a front side) of the second support platform 250 and a second side 264 (e.g., a rear side) of the second support platform 250.

In the illustrated example, the second support platform 250 comprises five crossing support channels (e.g., 260, 270, 272, 274, 276). For example, the second support platform 250 may comprise the first crossing support channel 260, a second crossing support channel 270, a third crossing support channel 272, a fourth crossing support channel 274, and a fifth crossing support channel 276. The second crossing support channel 270, the third crossing support channel 272, the fourth crossing support channel 274, and the fifth crossing support channel 276 can be substantially similar and/or identical in size, shape, and/or orientation to the first crossing support channel 260 and/or to the first transverse support channel 210. As such, the aforementioned description of the first crossing support channel 260 and/or the first transverse support channel 210 can apply to the second crossing support channel 270, the third crossing support channel 272, the fourth crossing support channel 274, and the fifth crossing support channel 276.

It will be appreciated that such a number of crossing support channels (e.g., five in this example) is not intended to be limiting. Rather, in other examples, any number (e.g., one or more) of the crossing support channels can be provided. In this example, the crossing support channels have a substantially similar and/or identical size/shape and can extend substantially parallel with respect to each other.

The first crossing support channel 260 can be located the first distance 218 from the first end 132 of the support shelf 130. The second crossing support channel 270 can be located the second distance 228 from the first end 132 of the support shelf 130. The third crossing support channel 272 can be located the third distance 230 from the first end 132 of the support shelf 130. The fourth crossing support channel 274 can be located the fourth distance 232 from the first end 132 of the support shelf 130. The fifth crossing support channel 276 can be located the fifth distance 234 from the first end 132 of the support shelf 130. In this example, the first crossing support channel 260 is located in closest proximity to the first end 132 while the fifth crossing support channel 276 is located in furthest proximity from the first end 132.

In some examples, a distance separating adjacent crossing support channels may vary depending on the transverse support channels. For example, the first separating distance 236 can separate the first crossing support channel 260 from the second crossing support channel 270. The second separating distance 238 can separate the second crossing support channel 270 from the third crossing support channel 272. The third separating distance 240 can separate the third crossing support channel 272 from the fourth crossing support channel 274. The fourth separating distance 242 can separate the fourth crossing support channel 274 from the fifth crossing support channel 276.

In this example, the first separating distance 236, the second separating distance 238, the third separating distance 240, and the fourth separating distance 242 may or may not be equal. For example, the second crossing support channel 270, the third crossing support channel 272, and the fourth crossing support channel 274 may be in closer proximity to each other than the first crossing support channel 260 is to the second crossing support channel 270 and/or than the fourth crossing support channel 274 is to the fifth crossing support channel 276.

In the illustrated example, the first transverse support channel 210 is substantially parallel to and collinear with the first crossing support channel 260, such that the first transverse support channel 210 and the first crossing support channel 260 are aligned and spaced the same distance from the first end 132. The second transverse support channel 220 may be substantially parallel to and collinear with the second crossing support channel 270, such that the second transverse support channel 220 and the second crossing support channel 270 are aligned and spaced the same distance from the first end 132. The third transverse support channel 222 may be substantially parallel to and collinear with the third crossing support channel 272, such that the third transverse support channel 222 and the third crossing support channel 272 are aligned and spaced the same distance from the first end 132. The fourth transverse support channel 224 may be substantially parallel to and collinear with the fourth crossing support channel 274, such that the fourth transverse support channel 224 and the fourth crossing support channel 274 are aligned and spaced the same distance from the first end 132. The fifth transverse support channel 226 may be substantially parallel to and collinear with the fifth crossing support channel 276, such that the fifth transverse support channel 226 and the first crossing support channel 276 are aligned and spaced the same distance from the first end 132.

Referring still to FIG. 2, the support shelf 130 comprises a third support platform 280. The third support platform 280 can extend between the first end 132 and the second end 134 of the support shelf 130. The third support platform 280 extends along the first support direction 202. In this example, the third support platform 280 extends substantially parallel to the first support platform 200 and to the second support platform 250.

The third support platform 280 is spaced a second support distance 282 away from the second support platform 250. In this example, the third support platform 280 and the second support platform 250 define a second support opening 284 between the second support platform 250 and the third support platform 280. In an example, the second support opening 284 is large enough to support a bottle 102 (e.g., a wine bottle), while not being so large so as to allow for the bottle 102 to fall through the second support opening 284. In an example, the second support opening 284 has a substantially similar and/or identical size as the first support opening 254, such that the second support distance 282 is substantially similar and/or identical to the first support distance 252.

It will be appreciated that the first support distance 252 (e.g., defining the first support opening 254) and the second support distance 282 (e.g., defining the second support opening 284) are not limited to the illustrated distances in FIG. 2. Rather, in other examples, the first support distance 252 and the second support distance 282 can be larger or smaller than as illustrated, such that the first support opening 254 and the second support opening 284 can support bottles 102 of different sizes (e.g., 375 milliliters, 750 milliliters, 1.5 liters). In a possible example, the first support distance 252 and/or the second support distance 282 can be smaller, such that the first support opening 254 and/or the second support opening 284 can be smaller so as to support smaller bottles 102, such as a 375 millimeter size, while limiting inadvertent rolling/movement of the bottles 102. In another possible example, the first support distance 252 and/or the second support distance 282 can be larger, such that the first support opening 254 and/or the second support opening 284 can be larger so as to support larger bottles 102, such as a 1.5 liter size, while limiting inadvertent rolling/movement of the bottles 102.

The third support platform 280 can define a third support channel 286 that is defined within a third upper surface 288 of the third support platform 280. In an example, the third upper surface 288 is substantially planar, flat, level, etc. In an example, the third upper surface 288 is substantially parallel to and/or coplanar with the first upper surface 206 and/or the second upper surface 258. The third support channel 286 can define a trough, indentation, furrow, trench, or the like that projects inwardly into the third support platform 280. In this example, the third support channel 286 extends along the first support direction 202 between the first end 132 and the second end 134 of the support shelf 130. In an example, the third support channel 286 can extend along at least about one half of a length of the third support platform 280. In another example, the third support channel 286 can extend along at least about three quarters of a length of the third support platform 280. In the illustrated example, the third support channel 286 can extend along substantially an entire length of the third support platform 280.

In the illustrated example, the support shelf 130 comprises a single, unitary piece that is one piece and is generally not able to be disassembled. For example, the support shelf 130 comprises a first attachment wall 290 and a second attachment wall 292. The first attachment wall 290 is positioned at the first end 132 of the support shelf 130. The first attachment wall 290 can extend along the second support direction 212 along the first end 132 of the support shelf 130. In this example, the first attachment wall 290 can be attached to the first end 132 of the first support platform 200, the second support platform 250, and the third support platform 280. The first attachment wall 290 can be attached in any number of ways to the first support platform 200, the second support platform 250, and the third support platform 280. For example, the first attachment wall 290 can be attached with fasteners (e.g., screws, nails, bolts, nuts, etc.), adhesives, snap-fit and/or locking means, or the like.

The second attachment wall 292 is positioned at the second end 134 of the support shelf 130. The second attachment wall 292 can extend along the second support direction 212 along the second end 134 of the support shelf 130. In this example, the first attachment wall 290 and the second attachment wall 292 are substantially parallel to each other and perpendicular to the first support platform 200, the second support platform 250, and the third support platform 280. The second attachment wall 292 can be attached to the second end 134 of the first support platform 200, the second support platform 250, and the third support platform 280. The second attachment wall 292 can be attached in any number of ways to the first support platform 200, the second support platform 250, and the third support platform 280. For example, the second attachment wall 292 can be attached with fasteners (e.g., screws, nails, bolts, nuts, etc.), adhesives, snap-fit and/or locking means, or the like.

The support shelf 130 comprises any number of materials. In some examples, the support shelf 130 comprises wood, metals, plastics, composite materials, or the like. In the aforementioned description, the first support platform 200, the second support platform 250, and the third support platform 280 are described as being separately attached to each other, such as with the first attachment wall 290 and the second attachment wall 292. In other examples, however, the support shelf 130 can be manufactured as a single, unitary piece, such that the first support platform 200, the second support platform 250, the third support platform 280, the first attachment wall 290, and the second attachment wall 292 are a single, unitary formed structure. In such an example, fasteners, adhesives, snap-fit and/or locking means, etc. may not be needed.

It will be appreciated that the support shelf 130 can be sized and/or optimized to hold and/or support a number of different sized bottles 102. For example, the support shelf 130 as illustrated can support both larger sized bottles 102 and smaller sized bottles 102. By being larger/smaller, it will be appreciated that the bottles 102 can be larger or smaller in length than as illustrated, larger or smaller in diameter (e.g., cross-sectional size) than as illustrated, etc. It is to be noted that if the dimensions of the support shelf 130 are changed, then the dimensions of the bottle rack assembly 100 (e.g., the width between the sidewalls 116, 126, the length of the support ledges 118, 128, etc.) may also be changed to accommodate for the support shelf 130.

III. First Support Channel 204

Figure 3:
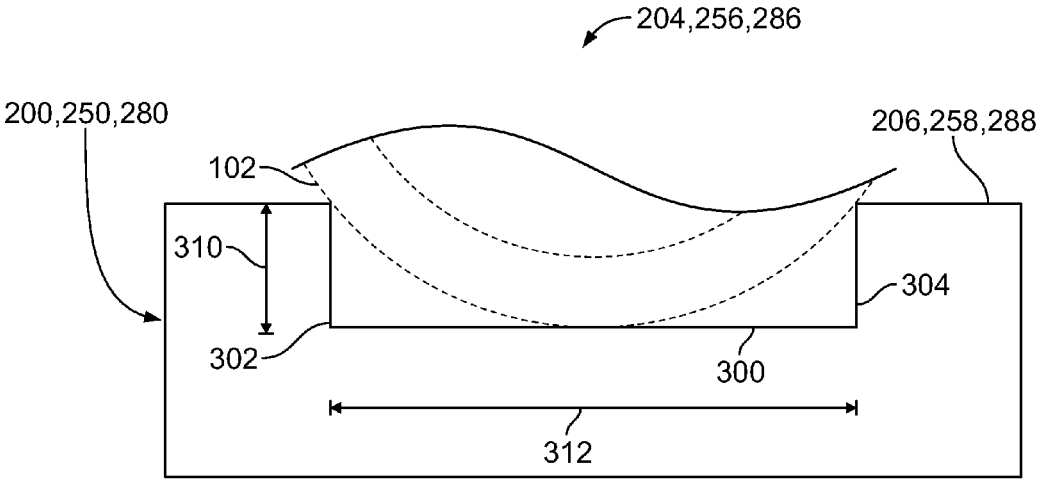
FIG. 3 is a cross-sectional view of an example support shelf channel.

Turning to FIG. 3, a cross-sectional view of the first support channel 204 of the first support platform 200 as viewed along lines 3-3 of FIG. 2 is illustrated. It will be appreciated that while the first support channel 204 is illustrated in FIG. 3, the second support channel 256 of the second support platform 250 and the third support channel 286 of the third support platform 280 may also be represented by the illustration in FIG. 3. As such, the description of the first support channel 204 with respect to the illustration of FIG. 3 is also applicable to the second support channel 256 and the third support channel 286, as the first support channel 204, the second support channel 256, and the third support channel 286 are substantially similar in structure, size, shape, etc. In this example, the first support channel 204 (e.g., and/or the second support channel 256, the third support channel 286, etc.) can support the bottle 102 (e.g., illustrated schematically with dashed lines). It will be appreciated that the position, size, etc. of the bottle 102 is merely exemplary, and, in other examples, may be larger or smaller than as illustrated.

The first support channel 204 (e.g., and/or the second support channel 256, the third support channel 286, etc.) of the first support platform 200 is defined by a first support wall 300, a second support wall 302, and a third support wall 304. In the illustrated example, the first support wall 300 is substantially parallel to the first upper surface 206. In this example, the first support wall 300 is non-planar with respect to the first upper surface 206. That is, the first support wall 300 can be recessed within an interior of the first support platform 200, such that the first support wall 300 is positioned in closer proximity to a center (e.g., a radial center) than the first upper surface 206 (e.g., a distance from a center of the first support platform 200 to the first support wall 300 is less than a distance from a center of the first support platform 200 to the first upper surface 206). In the illustrated example, the first support wall 300 is substantially flat, level, planar, etc.

The second support wall 302 and the third support wall 304 can be spaced apart from each other to define the first support channel 204 between the second support wall 302 and the third support wall 304. In this example, the second support wall 302 and the third support wall 304 are substantially parallel to each other while being non-planar with respect to each other. In one possible example, the second support wall 302 and the third support wall 304 can extend substantially perpendicularly with respect to the first support wall 300 and/or the first upper surface 206.

In this example, a height 310 of the second support wall 302 and the third support wall 304 is less than a width 312 of the first support wall 300. In this example, the width 312 is equivalent to a distance between the second support wall 302 and the third support wall 304. By having the illustrated dimensions, the bottle 102 can be received at least partially within the first support channel 204. For example, the bottle 102 can be oriented to extend along the first support direction 202 (e.g., into and out of the page as illustrated in FIG. 3). The bottle 102 can contact one or more of the first support wall 300, the second support wall 302, and/or the third support wall 304. The bottle 102 can therefore at least partially extend into the first support channel 204, such that the bottle 102 is limited from inadvertently rolling and/or from being dislodged from the first support channel 204. In a possible example, one or more of the first support channel 204, the second support channel 256, and/or the third support channel 286 can have a width 312 that is between about ½ inch (about 12.7 millimeters) to about 1 inch (about 25.4 millimeters). In another example, the height 310 can be between about 1/16 inch (about 1.59 millimeters) to about 1 inch (about 25.4 millimeters).

It will be appreciated that the width 312 defining the first support channel 204, the second support channel 256, and the third support channel 286 is not limited to the illustrated width 312 in FIGS. 2 and 3. Rather, in other examples, the width 312 can be larger or smaller than as illustrated, so as to support bottles 102 of different sizes (e.g., 375 milliliters, 750 milliliters, 1.5 liters). In a possible example, the width 312 can be smaller so as to support smaller bottles 102, such as a 375 milliliter size, while limiting inadvertent rolling/movement of the bottles 102. In another possible example, the width 312 can be larger so as to support larger bottles 102, such as a 1.5 liter size, while limiting inadvertent rolling/movement of the bottles 102.

IV. Transverse Support Channel

Figure 4:
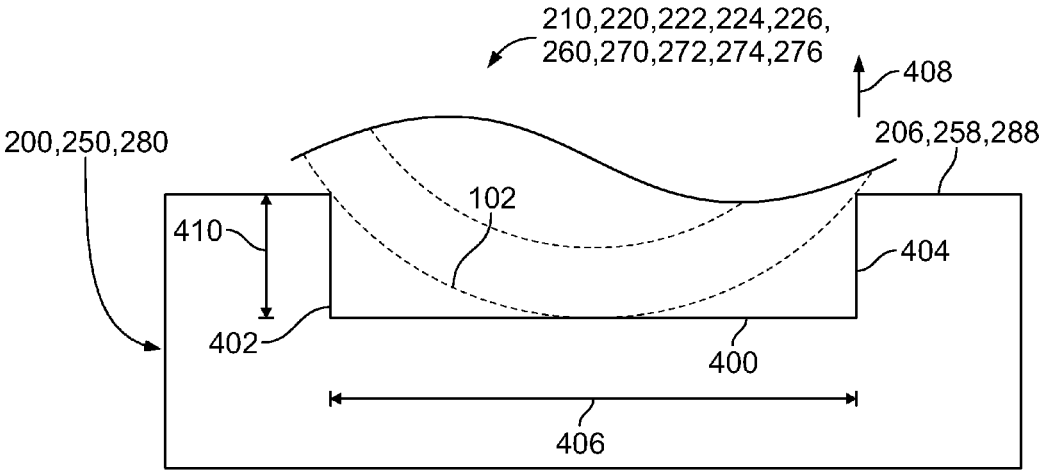
FIG. 4 is a cross-sectional view of an example support shelf transverse channel.

Turning to FIG. 4, a cross-sectional view of the first transverse support channel 210 of the first support platform 200 as viewed along lines 4-4 of FIG. 2 is illustrated. It will be appreciated that while the first transverse support channel 210 is illustrated in FIG. 4, the second transverse support channel 220, the third transverse support channel 222, the fourth transverse support channel 224, the fifth transverse support channel 226, the first crossing support channel 260, the second crossing support channel 270, the third crossing support channel 272, the fourth crossing support channel 274, and/or the fifth crossing support channel 276 are also represented by the illustration in FIG. 4. As such, the description of the first transverse support channel 210 with respect to the illustration of FIG. 4 is also applicable to the second transverse support channel 220, the third transverse support channel 222, the fourth transverse support channel 224, the fifth transverse support channel 226, the first crossing support channel 260, the second crossing support channel 270, the third crossing support channel 272, the fourth crossing support channel 274, and/or the fifth crossing support channel 276. Indeed, the second transverse support channel 220, the third transverse support channel 222, the fourth transverse support channel 224, the fifth transverse support channel 226, the first crossing support channel 260, the second crossing support channel 270, the third crossing support channel 272, the fourth crossing support channel 274, and/or the fifth crossing support channel 276 are substantially similar in structure, size, shape, etc. as the first transverse support channel 210.

The first transverse support channel 210 of the first support platform 200 is defined by a first support wall 400, a second transverse support wall 402, and a third transverse support wall 404. In some examples, the first support wall 400 may be planar (e.g., co-planar) with the first support wall 300, while in other examples, the first support wall 400 may not be planar with the first support wall 300. In the illustrated example, the second transverse support wall 402 and the third transverse support wall 404 can be spaced apart from each other to define the first transverse support channel 210 between the second transverse support wall 402 and the third transverse support wall 404. In this example, the second transverse support wall 402 and the third transverse support wall 404 are substantially parallel to each other while being non-planar with respect to each other. In one possible example, the second transverse support wall 402 and the third transverse support wall 404 can extend in a wall direction 408 that is substantially perpendicularly with respect to the first support wall 400 and/or the first upper surface 206.

In this example, a height 410 (which may be the same as or different than the height 310) of the second transverse support wall 402 and the third transverse support wall 404 is less than a width 406 of the first support wall 400. In this example, the width 406 is equivalent to a distance between the second transverse support wall 402 and the third transverse support wall 404. By having the illustrated dimensions, the bottle 102 can be received at least partially within the first transverse support channel 210. For example, the bottle 102 can be oriented to extend along the second support direction 212 (e.g., into and out of the page as illustrated in FIG. 4). The bottle 102 can contact one or more of the first support wall 400, the second transverse support wall 402, and/or the third transverse support wall 404. The bottle 102 can therefore at least partially extend into the first transverse support channel 210, such that the bottle 102 is limited from inadvertently rolling and/or from being dislodged from the first transverse support channel 210.

In a possible example, one or more of the transverse support channels 210, 220, 222, 224, 226, 260, 270, 272, 274, 276 can have a width 406 that is between about 1 inch (about 25.4 millimeters) to about 1.5 inches (about 38.1 millimeters). In an example, a distance separating the transverse support channels can be between about ¼ inch (about 6.35 millimeters) to about ¾ inch (about 19.05 millimeters) at a minimum and between about 1.5 inches (about 38.1 millimeters) to about 2 inches (about 50.8 millimeters) at a maximum.

It will be appreciated that the width 406 defining the transverse support channels 210, 220, 222, 224, 226, 260, 270, 272, 274, 276 is not limited to the illustrated width 406 in FIGS. 2 and 4. Rather, in other examples, the width 406 can be larger or smaller than as illustrated, so as to support bottles 102 of different sizes (e.g., 375 milliliters, 750 milliliters, 1.5 liters). In a possible example, the width 406 can be smaller so as to support smaller bottles 102, such as a 375 milliliter size, while limiting inadvertent rolling/movement of the bottles 102. In another possible example, the width 406 can be larger so as to support larger bottles 102, such as a 1.5 liter size, while limiting inadvertent rolling/movement of the bottles 102.

V. Support Shelf 130 Received Within Space 108

Figure 5:
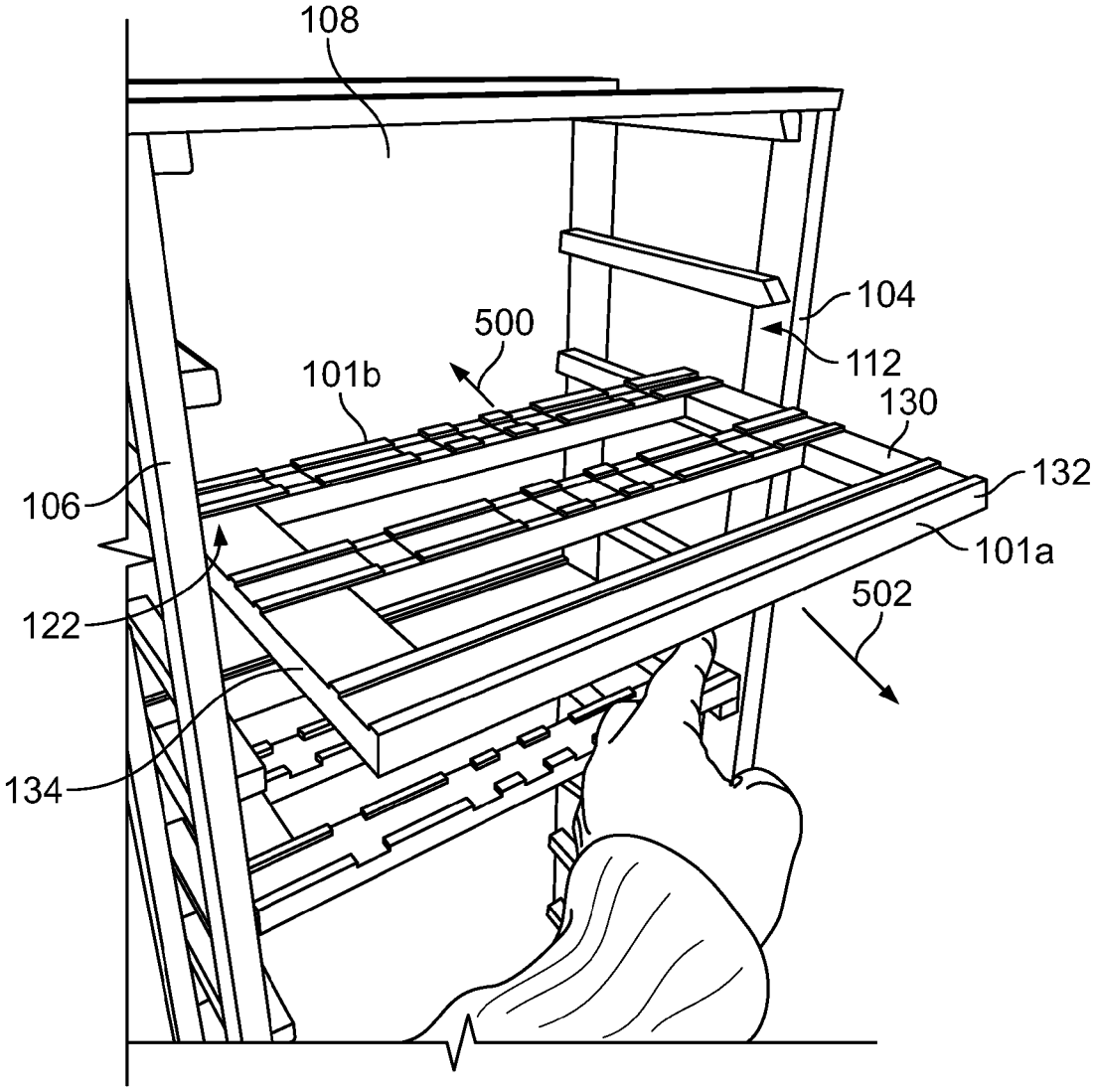
FIG. 5 is an illustration of an example support shelf as part of an example bottle rack assembly.

Turning now to FIG. 5, the support shelf 130 can be received within the space 108 defined by the first support structure 104 and the second support structure 106. In this example, the support shelf 130 can be moved in a first direction 500, with the first end 132 of the support shelf 130 being received within the first opening 112 of the first support structure 104. Additionally, with the support shelf 130 moving in the first direction 500, the second end 134 of the support shelf 130 is received within the second opening 122 of the second support structure 106. As such, the first end 132 of the support shelf 130 can rest on and/or be supported by the first support ledge 118 (obscured from view in FIG. 5 but visible in FIG. 1). The second end 134 of the support shelf 130 can rest on and/or be supported by the second support ledge 128 (obscured from view in FIG. 5 but visible in FIG. 1). In such an example, the support shelf 130 can rest in a substantially horizontal and/or flat orientation, such that the bottles 102 are substantially limited from inadvertently rolling off of the support shelf 130 either orthogonally or transversely.

The support shelf 130 can be selectively removed from the first support structure 104 and the second support structure 106. For example, the support shelf 130 can be moved in a second direction 502 that is opposite the first direction 500. As the support shelf 130 is moved in the second direction 502, the support shelf 130 is withdrawn and/or removed from the first support structure 104 and the second support structure 106.

Turning now to FIGS. 6A, 6B and 6C, the bottle 102 is illustrated as being supported in a first position. In this example, one or more of the bottles 102 can be oriented to extend along the first support direction 202 between the first end 132 and the second end 134 of the support shelf 130. In such an example, an axis extending between a top (e.g., a spout, opening, etc.) of the bottle 102 and a bottom/base of the bottle 102 can extend along the first support direction 202.

The bottles 102 can be supported in the first position in any number of ways. For example, as illustrated in FIG. 6A, the first support opening 254 can receive one of the bottles 102 (e.g., a first bottle) such that the bottle 102 extends along the first support direction 202. In addition or in the alternative, the second support opening 284 can receive one of the bottles 102 (e.g., a second bottle), such that the bottle 102 extends along the first support direction 202. In this way, the support shelf 130 can support a plurality of bottles 102 (e.g., two in this example) in the first position, with the bottle(s) 102 extending along the first support direction 202.

In another example, as illustrated in FIG. 6B, the first support channel 204 can receive one of the bottles 102 (e.g., a first bottle) such that the bottle 102 extends along the first support direction 202. In addition or in the alternative, the second support channel 256 can receive one of the bottles 102 (e.g., a second bottle), such that the bottle 102 extends along the first support direction 202. In addition or in the alternative, the third support channel 286 can receive one of the bottles 102 (e.g., a third bottle), such that the bottle 102 extends along the first support direction 202. In this way, the support shelf 130 can support a plurality of bottles 102 (e.g., three in this example) in the first position, with the bottles being supported within the support channels 204, 256, 286 of the support platforms 200, 250, 280.

Turning to FIG. 6C, the bottles 102 are illustrated as being supported in a second position, with one of the bottles 102 illustrated as being partially transparent to show features of the support shelf 130. In this example, one or more of the bottles 102 can be oriented to extend along the second support direction 212. As such, the bottles 102 supported in the first position (e.g., as illustrated in FIGS. 6A and 6B) are substantially perpendicular to the bottles 102 that are supported in the second position (e.g., as illustrated in FIG. 6C). In this example, an axis extending between a top (e.g., a spout, opening, etc.) of the bottle 102 and a bottom/base of the bottle 102 can extend along the second support direction 212.

The bottles 102 can be supported in the second position in any number of ways. For example, the first transverse support channel 210 and the first crossing support channel 260 can receive one of the bottles 102 (e.g., a first bottle) such that the bottle 102 extends along the second support direction 212. In addition or in the alternative, the second transverse support channel 220 and the second crossing support channel 270 can receive one of the bottles 102 (e.g., a second bottle) such that the bottle 102 extends along the second support direction 212. In addition or in the alternative, the third transverse support channel 222 and the third crossing support channel 272 can receive one of the bottles 102 (e.g., a third bottle) such that the bottle 102 extends along the second support direction 212. In addition or in the alternative, the fourth transverse support channel 224 and the fourth crossing support channel 274 can receive one of the bottles 102 (e.g., a fourth bottle) such that the bottle 102 extends along the second support direction 212. In addition or in the alternative, the fifth transverse support channel 226 and the fifth crossing support channel 276 can receive one of the bottles 102 (e.g., a fifth bottle) such that the bottle 102 extends along the second support direction 212. In this way, the support shelf 130 can support a plurality of bottles 102 (e.g., one or more in this example) in the second position, with the bottle(s) 102 extending along the second support direction 212.

VI. Second Example Support Shelf 700

Figure 7:
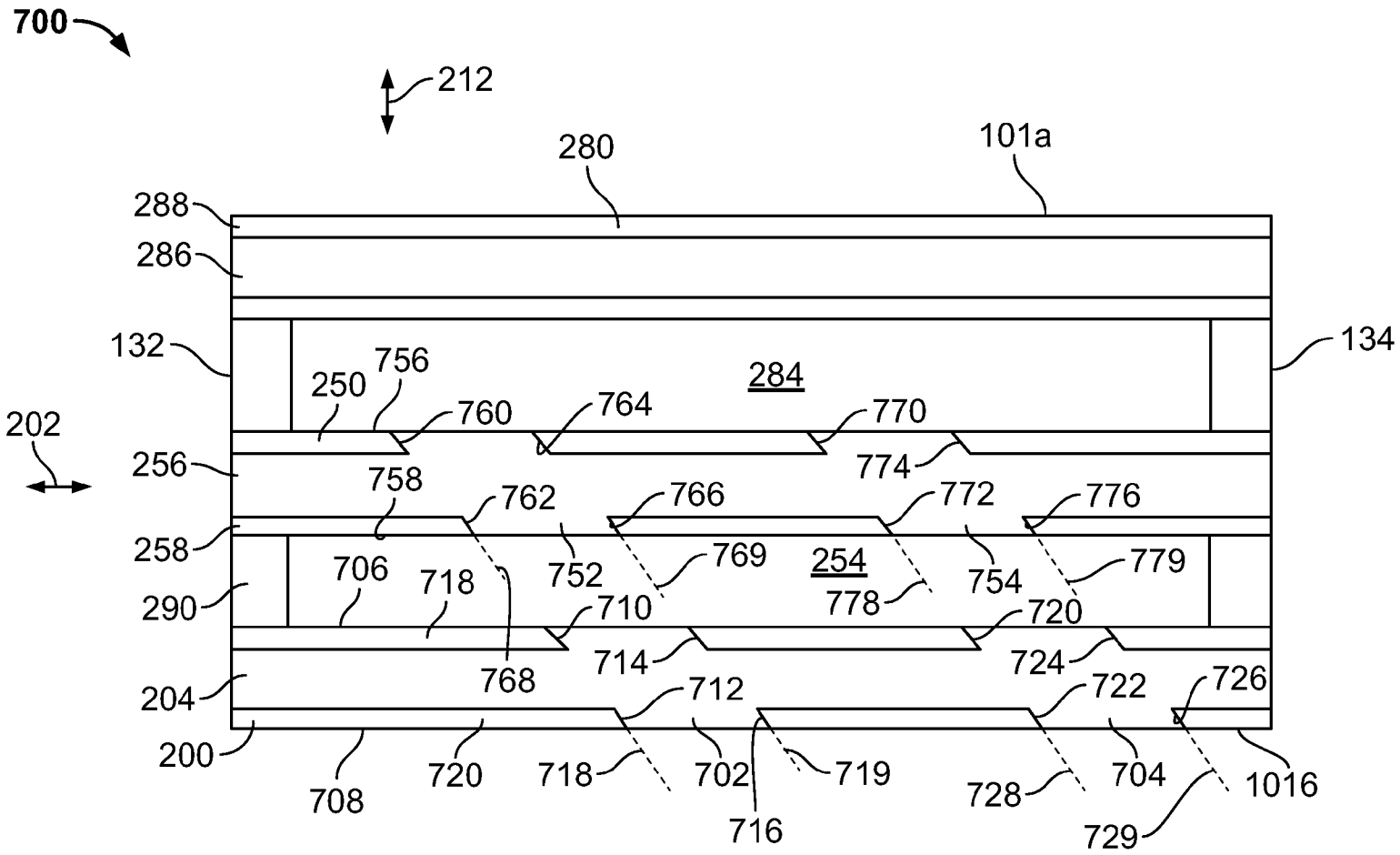
FIG. 7 is an illustration of an example support shelf for a bottle rack assembly designed for supporting a plurality of wine bottle sizes.
Figure 8:
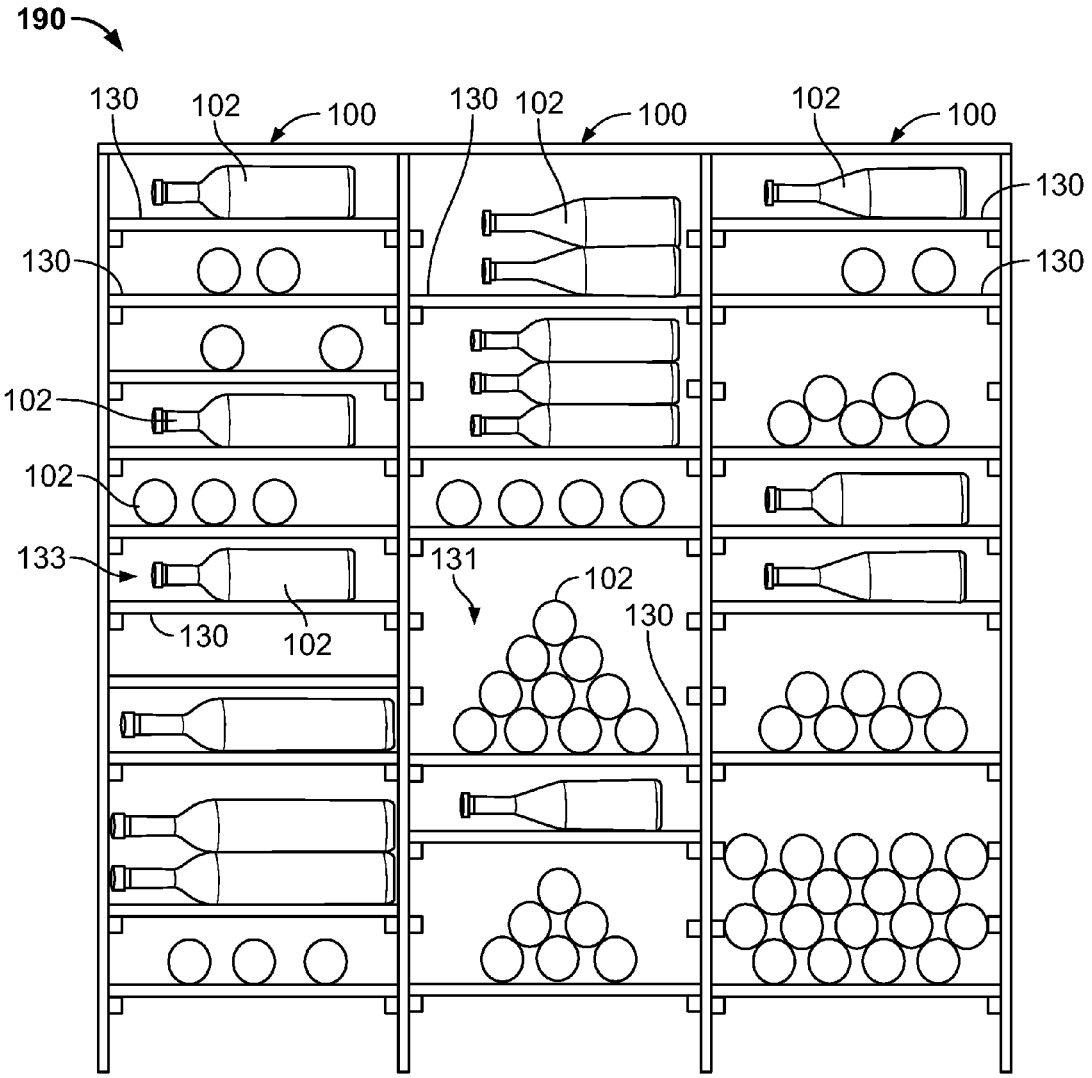
FIG. 8 is an illustration of an example support shelf supporting a plurality of bottles in a plurality of configurations.

Referring now to FIG. 7, a second example support shelf 700 is illustrated. The support shelf 700 can be used for supporting one or more bottles 102 in a similar manner as the support shelf 130 in FIG. 2. The support shelf 700 is similar in some respects to the support shelf 130. For example, the support shelf 700 comprises the first support platform 200, the second support platform 250, and the third support platform 280. The first support platform 200, the second support platform 250, and the third support platform 280 can extend between the first end 132 and the second end 134.

The first support platform 200 comprises the first support channel 204 and the first upper surface 206. In this example, the first support platform 200 comprises a first transverse support channel 702. The first transverse support channel 702 can extend between a first side 706 and a second side 708 of the first support platform 200. The first transverse support channel 702 is defined between a first edge 710, a second edge 712, a third edge 714, and a fourth edge 716. In the illustrated example, the first edge 710 is separated a different distance from the first end 132 than the second edge 712. For example, the first edge 710 may be located in closer proximity to the first end 132 than the second edge 712. Similarly, in the illustrated example, the third edge 714 is separated a different distance from the first end 132 than the fourth edge 716. For example, the third edge 714 may be located in closer proximity to the first end 132 than the fourth edge 716.

The first edge 710 and the second edge 712 can extend along a first axis 718. The third edge 714 and the fourth edge 716 can extend along a second axis 719. In an example, the first axis 718 and/or the second axis 719 are non-perpendicular with respect to the first support direction 202 along which the first support platform 200 extends. For example, the first axis 718 and the second axis 719 can extend parallel to each other, but may extend at a non-perpendicular angle with respect to the first side 706, the second side 708, and the first support direction 202.

The first support platform 200 comprises a second transverse support channel 704. The second transverse support channel 704 can extend between the first side 706 and the second side 708 of the first support platform 200. The second transverse support channel 704 is defined between a first edge 720, a second edge 722, a third edge 724, and a fourth edge 726. In the illustrated example, the first edge 720 is separated a different distance from the first end 132 than the second edge 722. For example, the first edge 720 may be located in closer proximity to the first end 132 than the second edge 722. Similarly, in the illustrated example, the third edge 724 is separated a different distance from the first end 132 than the fourth edge 726. For example, the third edge 724 may be located in closer proximity to the first end 132 than the fourth edge 726.

The first edge 720 and the second edge 722 can extend along a third axis 728. The third edge 724 and the fourth edge 726 can extend along a second axis 728. In an example, the third axis 728 and/or the fourth axis 729 are non-perpendicular with respect to the first support direction 202 along which the first support platform 200 extends. For example, the third axis 728 and the fourth axis 719 can extend parallel to each other, but may extend at a non-perpendicular angle with respect to the first side 706, the second side 708, and the first support direction 202.

The second support platform 250 comprises the second support channel 256 and the second upper surface 258. In this example, the second support platform 250 comprises a third transverse support channel 752. The third transverse support channel 752 can extend between a first side 756 and a second side 758 of the second support platform 250. The third transverse support channel 752 is defined between a first edge 760, a second edge 762, a third edge 764, and a fourth edge 766. In the illustrated example, the first edge 760 is separated a different distance from the first end 132 than the second edge 762. For example, the first edge 760 may be located in closer proximity to the first end 132 than the second edge 762. Similarly, in the illustrated example, the third edge 764 is separated a different distance from the first end 132 than the fourth edge 766. For example, the third edge 764 may be located in closer proximity to the first end 132 than the fourth edge 766.

The first edge 760 and the second edge 762 can extend along a fifth axis 768. The third edge 764 and the fourth edge 766 can extend along a sixth axis 769. In an example, the fifth axis 768 and/or the sixth axis 769 are non-perpendicular with respect to the first support direction 202 along which the second support platform 250 extends. For example, the fifth axis 768 and the sixth axis 769 can extend parallel to each other, but may extend at a non-perpendicular angle with respect to the first side 756, the second side 758, and the first support direction 202. In this example, respective edges (e.g., 760, 762, 764, 766) of the third transverse support channel 752 are located in closer proximity to the first end 132 than respective edges (e.g., 710, 712, 714, 716) of the first transverse support channel 702.

The second support platform 250 comprises a fourth transverse support channel 754. The fourth transverse support channel 754 can extend between the first side 756 and the second side 758 of the second support platform 250. The fourth transverse support channel 754 is defined between a first edge 770, a second edge 772, a third edge 774, and a fourth edge 776. In the illustrated example, the first edge 770 is separated a different distance from the first end 132 than the second edge 772. For example, the first edge 770 may be located in closer proximity to the first end 132 than the second edge 772. Similarly, in the illustrated example, the third edge 774 is separated a different distance from the first end 132 than the fourth edge 776. For example, the third edge 774 may be located in closer proximity to the first end 132 than the fourth edge 776.

The first edge 770 and the second edge 772 can extend along a seventh axis 778. The third edge 724 and the fourth edge 726 can extend along an eighth axis 778. In an example, the seventh axis 778 and/or the eighth axis 778 are non-perpendicular with respect to the first support direction 202 along which the second support platform 250 extends. For example, the seventh axis 778 and the eighth axis 779 can extend parallel to each other, but may extend at a non-perpendicular angle with respect to the first side 756, the second side 758, and the first support direction 202. In this example, respective edges (e.g., 770, 772, 774, 776) of the fourth transverse support channel 754 are located in closer proximity to the first end 132 than respective edges (e.g., 718, 719, 728, 729) of the second transverse support channel 704.

In this example, the first transverse support channel 702 and the third transverse support channel 752 are angled such that the first axis 718 and the fifth axis 768 are substantially parallel and co-linear, while the second axis 719 and the sixth axis 769 are substantially parallel and co-linear. As such, bottles can be supported within the first transverse support channel 702 and the third transverse support channel 752 in a way that the labels can be displayed to a user facing the support shelf 700.

Similarly, in this example, the second transverse support channel 704 and the fourth transverse support channel 754 are angled such that the third axis 728 and the seventh axis 778 are substantially parallel and co-linear, while the fourth axis 729 and the eighth axis 779 are substantially parallel and co-linear. As such, bottles can be supported within the second transverse support channel 704 and the fourth transverse support channel 754 in a way that the labels can be displayed to the user facing the support shelf 700.

Referring now to FIG. 8, the second example bottle rack assembly 190 is illustrated. As illustrated, the second example bottle rack assembly 190 can support the bottles 102 on the shelves 130 in a variety of different configurations. Indeed, some of these configurations/orientations have been illustrated and described with respect to FIGS. 6A, 6B, and 6C. In addition, the shelves 130 can support the bottles 102 in a pyramid configuration (e.g., as illustrated at the first location 131) in which a plurality of bottles 102 are stacked upon each other (e.g., vertically stacked so as to have a plurality of rows). The shelves 130 can be inserted and removed from the bottle rack assemblies 100 so as to adjust the position of the shelves 130 (e.g., vertically up and down) so as to accommodate different configurations of the bottles 102 in both stacked and non-stacked configurations.

VII. Benefits

As described above and illustrated with respect to FIGS. 1 to 8, the bottle rack assembly 100 provides a number of benefits. For example, the support shelf 130, 700 of the bottle rack assembly 100 can support bottles 102 in a plurality of orientations. That is, the bottles 102 can be supported in the orientation illustrated in FIGS. 6A, 6B, and 6C or in an angled orientation as illustrated in FIG. 7. The support shelf 130, 700 is not limited to supporting a single bottle but, rather, can support a multitude of bottles. Indeed, as illustrated in FIG. 8, the bottle rack assembly 100 can support a plurality of bottles 102 on each support shelf 130, 700. Moreover, the plurality of bottles 102 supported on each support shelf can be supported in either of orientations illustrated herein. As such, in some examples, some of the bottles 102 that are supported on the bottle rack assembly 100 can be supported in a "label out" orientation while some of the bottles 102 can be supported with the neck out. In other examples, such as illustrated in FIG. 7, the bottles 102 can be supported in an angled orientation such that the label is displayed while the neck is out.

Although the subject matter has been described in language specific to structural features or methodological acts, it is to be understood that the subject matter defined in the appended claims is not necessarily limited to the specific features or acts described above. Rather, the specific features and acts described above are disclosed as example forms of implementing at least some of the claims.

Various operations of embodiments are provided herein. The order in which some or all of the operations described should not be construed to imply that these operations are necessarily order dependent. Alternative ordering will be appreciated having the benefit of this description. Further, it will be understood that not all operations are necessarily present in each embodiment provided herein. Also, it will be understood that not all operations are necessary in some embodiments.

Many modifications may be made to the instant disclosure without departing from the scope or spirit of the claimed subject matter. Unless specified otherwise, "first," "second," or the like are not intended to imply a temporal aspect, a spatial aspect, an ordering, etc. Rather, such terms are merely used as identifiers, names, etc. for features, elements, items, etc. For example, a first end and a second end generally correspond to end A and end B or two different or two identical ends or the same end.

Moreover, "exemplary" is used herein to mean serving as an example, instance, illustration, etc., and not necessarily as advantageous. As used in this application, "or" is intended to mean an inclusive "or" rather than an exclusive "or". In addition, "a" and "an" as used in this application are generally to be construed to mean "one or more" unless specified otherwise or clear from context to be directed to a singular form. Also, at least one of A and B or the like generally means A or B or both A and B. Furthermore, to the extent that "includes", "having", "has", "with", or variants thereof are used in either the detailed description or the claims, such terms are intended to be inclusive in a manner similar to "comprising".

Also, although the disclosure has been illustrated and described with respect to one or more implementations, equivalent alterations and modifications will occur to others skilled in the art based upon a reading and understanding of this specification and the annexed drawings. The disclosure includes all such modifications and alterations and is limited only by the scope of the following claims. In particular regard to the various functions performed by the above described components (e.g., elements, resources, etc.), the terms used to describe such components are intended to correspond, unless otherwise indicated, to any component which performs the specified function of the described component (e.g., that is functionally equivalent), even though not structurally equivalent to the disclosed structure. In addition, while a particular feature of the disclosure may have been disclosed with respect to only one of several implementations, such feature may be combined with one or more other features of the other implementations as may be desired and advantageous for any given or particular application.

What is claimed is:

1. A bottle rack assembly for selectively supporting one or more bottles, the bottle rack assembly comprising:

a support shelf extending between a first end and a second end, the first end of the support shelf configured to be supported by a first support structure, the second end of the support shelf configured to be supported by a second support structure, the support shelf comprising:

a first support platform extending between the first end and the second end, the first support platform defining:

a first support channel configured to receive one or more of the bottles in a first position, the first support channel at least partially defined by a first bottom support wall portion; and at least one transverse support channel, the transverse support channel extending in a direction that is substantially perpendicular to the first support channel, the transverse support channel configured to receive one or more of the bottles in a second position that is different than the first position, the transverse support channel at least partially defined by a second bottom support wall portion, wherein the first bottom support wall portion and the second bottom support wall portion are substantially coplanar; and a second support platform extending between the first end and the second end, the second support platform defining a second support channel.

2. The bottle rack assembly of claim 1, wherein the first support channel of the first support platform is defined by a first support wall, which comprises the first bottom support wall portion, on which the bottle is configured to rest and contact in the first position, and the second bottom support wall portion, on which the bottle is configured to rest and contact in the second position, a second support wall, and a third support wall.

3. The bottle rack assembly of claim 2, wherein the first support wall is substantially parallel to the first upper surface, the first support wall non-planar with respect to the first upper surface.

4. The bottle rack assembly of claim 3, wherein the second support wall and the third support wall are spaced apart to define the first support channel between the second support wall and the third support wall, the second support wall and the third support wall extending in a wall direction that is substantially perpendicular with respect to the first support wall.

5. The bottle rack assembly of claim 1, wherein the first support channel is configured to receive a bottle such that the bottle extends along a first support direction.

6. A bottle rack assembly for selectively supporting one or more bottles, the bottle rack assembly comprising:

a first support structure extending substantially vertically along a first direction, the first support structure defining a first opening;

a second support structure extending substantially vertically along a second direction that is substantially parallel to the first direction, the second support structure defining a second opening, the second opening spaced apart and facing the first opening of the first support structure; and a support shelf extending between a first end and a second end, the first end of the support shelf configured to be received within the first opening, the second end of the support shelf configured to be received within the second opening such that the support shelf is supported between the first support structure and the second support structure, the support shelf comprising:

a first support platform extending between the first end and the second end, the first support platform extending along a first support direction that is substantially perpendicular to the first direction and the second direction, the first support platform defining:

a first support channel defined within a first upper surface of the first support platform; and a first transverse support channel defined within the first upper surface of the first support platform, the first transverse support channel extending along a second support direction that is substantially perpendicular to the first support direction, wherein the first support channel extends non-parallel to the first transverse support channel.

7. The bottle rack assembly of claim 6, wherein the first support platform comprises a plurality of transverse support channels.

8. The bottle rack assembly of claim 6, wherein the first transverse support channel is defined by a first support wall, a second transverse support wall, and a third transverse support wall, the first support wall defining a bottom of the first support channel and the first transverse support channel.

9. The bottle rack assembly of claim 8, wherein the first support wall is substantially parallel to the first upper surface, the first support wall non-planar with respect to the first upper surface, the first support wall being substantially planar.

10. The bottle rack assembly of claim 9, wherein the second transverse support wall and the third transverse support wall are spaced apart to define the first transverse support channel between the second transverse support wall and the third transverse support wall, the second transverse support wall and the third transverse support wall extending in a wall direction that is substantially perpendicular with respect to the first support wall.

11. The bottle rack assembly of claim 10, wherein the first transverse support channel is configured to at least partially receive a bottle such that the bottle extends along the second support direction, the bottle configured to rest on and contact the first support wall.

12. A bottle rack assembly for selectively supporting one or more bottles, the bottle rack assembly comprising:

a support shelf extending between a first end and a second end, the support shelf comprising:

a first support platform extending between the first end and the second end, the first support platform extending along a first support direction, the first support platform defining:

a first support channel defined within a first upper surface of the first support platform, the first support channel extending along the first support direction between the first end and the second end of the support shelf;

a first transverse support channel defined within the first upper surface of the first support platform, the first transverse support channel extending along a second support direction that is substantially perpendicular to the first support direction such that the first transverse support channel intersects the first support channel, the first transverse support channel located a first distance from the first end of the support shelf;

a second support platform extending between the first end and the second end, the second support platform extending along the first support direction, the second support platform spaced a first support distance apart from the first support platform to define a first support opening between the first support platform and the second support platform, the second support platform defining:

a second support channel defined within a second upper surface of the second support platform, the second support channel extending along the first support direction between the first end and the second end of the support shelf;

a first crossing support channel defined within the second upper surface of the second support platform, the first crossing support channel extending along the second support direction that is substantially perpendicular to the first support direction such that the first crossing support channel intersects the second support channel, the first crossing support channel located the first distance from the first end of the support shelf;

a third support platform extending between the first end and the second end, the third support platform extending along the first support direction, the third support platform spaced a second support distance apart from the second support platform to define a second support opening between the second support platform and the third support platform, the third support platform defining:

a third support channel defined within a third upper surface of the third support platform, the third support channel extending along the first support direction between the first end and the second end of the support shelf.

13. The bottle rack assembly of claim 12, wherein the first support opening is configured to receive a bottle such that the bottle extends along the first support direction.

14. The bottle rack assembly of claim 13, wherein the second support opening is configured to receive a second bottle such that the second bottle extends along the first support direction.

15. The bottle rack assembly of claim 12, wherein the first transverse support channel is configured to at least partially receive a bottle, the first crossing support channel is configured to at least partially receive the bottle such that the bottle extends along the second support direction and substantially perpendicular to the first support direction.

16. The bottle rack assembly of claim 12, comprising:

a first support structure extending substantially vertically along a first direction, the first support structure defining a first opening; and a second support structure extending substantially vertically along a second direction that is substantially parallel to the first direction, the second support structure defining a second opening, the second opening spaced apart and facing the first opening of the first support structure.

17. The bottle rack assembly of claim 16, wherein the first end of the support shelf is configured to be received within the first opening, the second end of the support shelf configured to be received within the second opening such that the support shelf is supported between the first support structure and the second support structure.

18. The bottle rack assembly of claim 17, wherein the support shelf is removably supported by the first support structure and the second support structure.

19. The bottle rack assembly of claim 16, wherein the first support structure defines a plurality of first openings arranged vertically along the first support structure, the second support structure defines a plurality of second openings arranged vertically along the second support structure.

20. The bottle rack assembly of claim 12, wherein the support shelf is configured to receive a bottle such that, in a first position, the bottle extends along the first support direction, and, in a second position, the bottle extends along the second support direction that is substantially perpendicular to the first support direction.

* * * * *